US006080935A

United States Patent [19]

Lanoue et al.

[11] Patent Number: 6,080,935

[45] Date of Patent: Jun. 27, 2000

[54] FOLDED INSULATED FOIL CONDUCTOR AND METHOD OF MAKING SAME

[75] Inventors: Thomas J. Lanoue, Cary, N.C.; Richard P. Marek, Danville, Va.

[73] Assignee: ABB Power T&D Company Inc., Raleigh, N.C.

[21] Appl. No.: 09/119,791

[22] Filed: Jul. 21, 1998

[51] Int. Cl.[7] ..... H01B 7/00

[52] U.S. Cl. ..... 174/117 F; 174/117 FF

[58] Field of Search ..... 174/117 F, 117 FF, 174/117 A, 117 AS; 29/825, 829

[56] References Cited

U.S. PATENT DOCUMENTS

| | | | |
|---|---|---|---|
| 1,278,920 | 9/1918 | Harsch | 174/117 |
| 3,202,756 | 8/1965 | Stanback | 174/99 |
| 3,306,971 | 2/1967 | Olson et al. | 174/119 |
| 3,317,657 | 5/1967 | Eisler | 174/117 |
| 3,396,230 | 8/1968 | Crimmins | 174/72 |
| 3,407,263 | 10/1968 | Miller | 174/113 |
| 3,408,453 | 10/1968 | Shelton | 174/68.5 |
| 3,461,222 | 8/1969 | Jorgensen | 174/117 |
| 3,473,218 | 10/1969 | Travis | 29/624 |
| 3,483,058 | 12/1969 | Benz | 156/306 |
| 3,600,802 | 8/1971 | Jorgensen | 29/624 |
| 3,639,680 | 2/1972 | Dempsey et al. | 174/117 FF |
| 3,708,610 | 1/1973 | Kozel et al. | 174/72 B |
| 3,723,797 | 3/1973 | Anderson et al. | 310/196 |
| 3,819,443 | 6/1974 | Simons et al. | 156/204 |
| 3,902,938 | 9/1975 | Eller et al. | 156/54 |
| 3,956,574 | 5/1976 | Weiner | 174/68 B |
| 3,968,321 | 7/1976 | Olszewski et al. | 174/36 |
| 3,989,561 | 11/1976 | Cotton | 156/54 |
| 4,406,914 | 9/1983 | Kincaid | 174/107 |
| 4,552,990 | 11/1985 | Persson et al. | 174/117 FF |
| 4,658,090 | 4/1987 | Coon | 174/119 R |
| 5,281,488 | 1/1994 | Poulsen | 428/624 |
| 5,393,933 | 2/1995 | Goertz | 174/117 R |
| 5,483,021 | 1/1996 | Saen et al. | 174/117 FF |

*Primary Examiner*—Kristine Kincaid
*Assistant Examiner*—William H Mayo, III
*Attorney, Agent, or Firm*—Woodcock Washburn Kurtz Mackiewicz & Norris LLP

[57] ABSTRACT

A method of making various insulated conductor sizes during a transformer coil winding process by slitting and bonding insulating sheet materials and foil sheet conductor into a composite foil conductor/insulation. The method includes folding the composite into a substantially U-shaped length having a central portion between two leg portions with each leg portion having a free end. The method also includes folding the leg portions of the "U" inwardly to a position substantially parallel to the central portion of the "U" to bring the free ends of the leg portions into opposing relation to provide a folded insulated foil conductor having a two-conductor thickness surrounded by insulation. Provision is also made for increasing the cross-sectional area of the conductor.

21 Claims, 1 Drawing Sheet

FOLDED INSULATED FOIL CONDUCTOR AND METHOD OF MAKING SAME

BACKGROUND OF THE INVENTION

The present invention relates to a folded insulated foil conductor for use in electrical devices and more particularly to an improved folded insulated foil conductor for use in transformer coils and the method of making the same.

Generally, insulated conductors for electrical apparatus are made from conductor material such for example as aluminum or copper and have a substantially rectangular cross-sectional area with rounded corners. The conductor material is usually insulated in a separate process. These standard rectangular conductors only come in discrete sizes.

It would be desirable to provide an electrical equipment manufacturer with a method for applying insulated conductors to his apparatus at a low manufacturing cost with a high degree of flexibility in size and cross-sectional area without a loss in dielectric performance. Such flexibility of conductor size and area would allow the manufacturer to fully optimize a design to achieve the lowest overall cost.

SUMMARY OF THE INVENTION

It is an object of the present invention to provide an improved process for producing various insulated conductor sizes during a coil winding process by slitting and folding standard insulating sheet materials and foil sheet conductor on the fly, i.e. while moving. By slitting on the fly, any foil width can be folded into nearly any cross-sectional size and the conductor cross-sectional area can be varied by folding the foil sheet conductor over additional foil filler strips. The folded foil conductor is simultaneously insulated by folding slit sheet insulation during the same process. It is a further object of the invention to provide a process which has the advantages of slitting and folding the insulated conductor on the fly during the coil winding process to provide a conductor with flexible dimensional sizes, flexible and incremental conductor cross-sectional areas, rounded edges for superior dielectric performance, substantially reduced conductor inventory, elimination of pre-insulating and storage of insulated conductor, and thus the ability to insulate, size, and use as needed.

In accordance with one aspect of the invention there is provided a method of making a folded insulated foil conductor including the steps of bonding a length of sheet insulation material to a corresponding length of a foil conductor material to provide a length of flat composite foil conductor/insulation. The method includes [folding the length of composite foil/conductor/insulation longitudinally into a substantially U-shaped length having a central portion between two leg portions. The method further includes folding the leg portions of the "U" inwardly to a position substantially parallel to the central portion of the "U" to bring the free ends of the leg portions into opposing relation to provide a folded insulated foil conductor having two conductor thickness surrounded by insulation.] In another aspect of the invention the method includes the step of inserting an un-insulated filler foil conductor strip having a width corresponding to the central portion of the "U" into the U-shaped length prior to folding the leg portions of the "U" to increase the conductor cross-sectional area of the folded insulated foil conductor.

In accordance with another aspect of the invention there is provided a method of making a smooth, rounded edge and tightly insulated turn conductor for distribution transformers comprising the steps of feeding a length of sheet insulation material to an assembly station, feeding a length of foil conductor material to the assembly station, at the assembly station, bonding the length of sheet insulation material to a corresponding length of the foil conductor material to provide a length of flat composite foil conductor/insulation, folding the length of composite foil conductor/insulation longitudinally into a substantially U-shaped length having a central portion between two leg portions, and folding the leg portions of the "U" inwardly to a position substantially parallel to the central portion of the "U" to bring the free ends of the leg portions into a substantially abutting relation to provide a folded insulated coil conductor having a two conductor thickness surrounded by insulation and having smooth rounded edges.

In accordance with a further aspect of the invention there is provided a folded insulated foil conductor for distribution transformers comprising a length of sheet insulation material bonded to a corresponding length of coil conductive material to provide a length of flat composite foil conductor/insulation. [The length of composite conductor insulation is folded longitudinally into a substantially U-shaped length having a central portion between two leg portions. The leg portions of the "U" being folded inwardly to a position substantially parallel to the horizontal central portion of the "U" to bring the free ends of the leg portions into opposing relation to provide a folded insulated foil conductor having two conductor thickness surrounded by insulation.] In another aspect of the invention an un-insulated filler foil conductor strip is disposed centrally in the folded insulated foil conductor to increase the conductor cross-sectional area of the folded insulated foil conductor.

For further objects and advantages of the invention reference may be had to the following detailed description of the preferred embodiment taken in conjunction with the accompanying drawings.

DESCRIPTION OF THE PREFERRED EMBODIMENT

Figure 1:
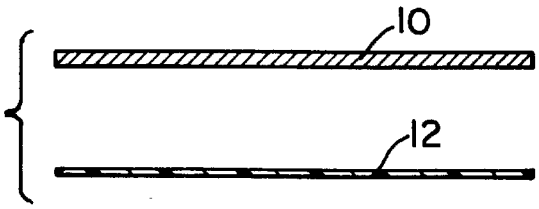
FIG. 1 is an illustration of a cross-section of a length of foil conductor superimposed over a length of a sheet of insulation prior to being bonded together.
Figure 2:
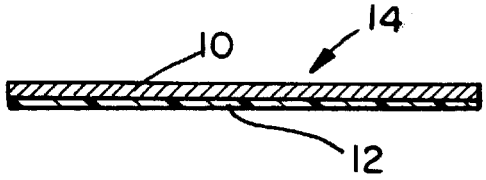
FIG. 2 is an illustration of a cross-section of the foil conductor/insulation composite.
Figure 3:
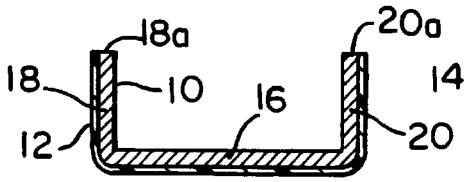
FIG. 3 is an illustration of a cross-section of the partial insulation wrap at the initial longitudinal U-shaped fold.

The preferred form of the method of the present invention of making a folded insulated foil conductor will now be described in connection with FIGS. 1–6. The insulated foil conductor includes a length of [foil conductor material 10] and a length of insulation material 12. In practicing the method the foil conductor material 10 is first slit into a [predetermined width ] and the sheet insulation material 12 is slit into a [corresponding width.] A length of the slit foil conductor material 10 and a corresponding length of the slit sheet [insulation material 12] are fed to an assembly station where the length of sheet insulation material 12 and the corresponding length of foil conductor material 10 are bonded to each other to provide a length of flat composite foil conductor/insulation 14, FIG. 2. A length of the composite foil conductor/insulation 14 is then fed through a suitable folding machine where it is folded longitudinally into a substantially "U" shaped length having a central portion 16 between two leg portions 18 and 20, FIG. 3. The leg portions 18 and 20 of the "U" are folded inwardly to a position substantially parallel to the central portion 16 of the "U" to bring the free ends 18*a,* 20*a* of the leg portions 18 and 20 into opposing relation, FIG. 4, to provide a folded insulated foil conductor 22 having a two-conductor thickness 10 surrounded by insulation 12. In the preferred form of the invention both the foil conductor material 10 and the sheet insulation material 12 are moving (on the fly) during the steps of slitting and bonding the materials. Also in the preferred method of the invention the foil conductor material 10 and the sheet insulation material 12 in the composite foil conductor/insulation 14 are moving (on the fly) during all of the steps of the method of making the foil insulated foil conductor 22.

Figure 4:
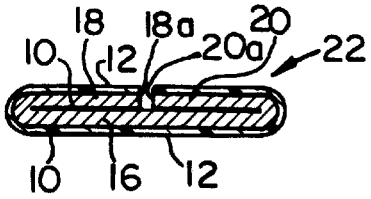
FIG. 4 is an illustration of a cross-section of the final folded longitudinal conductor with insulation wrap.

As may be seen in FIG. 4 the folded insulated foil conductor 22 is folded longitudinally such that the ends of the conductor material 10 and the ends of the insulation material 12 nearly touch in the middle, resulting in two conductor thickness' 10 surrounded by insulation 12. The folding concept provides a unique method for obtaining a smooth, rounded, and tightly insulated turn conductor for distribution transformers. The prior art method for achieving a smooth rounded foil edge or turn was by conditioning the edge of the conductor by means of mechanical rollers. Such prior art method required precise mechanical adjustment, produced variable results, was limited to large foil thicknesses and was insulated in a separate process thus making it extremely difficult to make and wind a coil on the fly. Another alternative to obtaining relatively smooth turn edges for foil conductors was by the use of static electricity or by electrically burning the edges, which was a slow and expensive process. Again it required a separate step for insulating the conductor.

Figure 5:
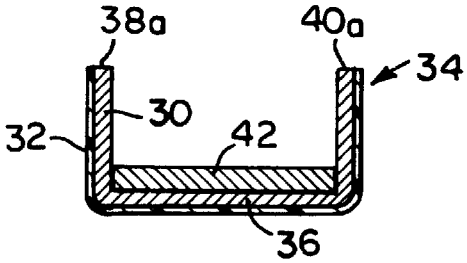
FIG. 5 is an illustration of a cross-section of the initial longitudinal U-shaped fold with a partial insulation wrap similar to FIG. 3 but with the inclusion of a filler conductor.
Figure 6:
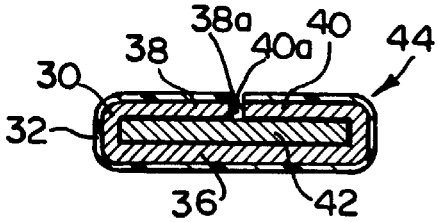
FIG. 6 is an illustration of a cross-section of the folded insulated foil conductor with a filler conductor inserted to increase the cross sectional area.

The present invention provides a relatively simple method for obtaining smooth and rounded turn edges. It also has the additional advantage of adding un-insulated filler foil strips to increase the conductor cross-sectional area. This is illustrated in FIGS. 5 and 6. In FIG. 5 it will be seen that a length of foil conductor material 30 has been bonded to a corresponding length of insulating material 32 to provide a length of flat composite foil conductor/insulation 34 that has been folded longitudinally into a substantially "U" shaped length having a central portion 36 between two leg portions 38 and 40. An un-insulated filler foil conductor strip 42 is disposed centrally in the folded insulated foil conductor after which the leg portions 38 and 40 of the "U" are folded inwardly to the position substantially parallel to the horizontal central portion of the "U" to bring the free ends 38*a,* 40*a* of the leg portions into opposing relation, as shown in FIG. 6, to provide a folded insulated foil conductor 44 having the conductor cross-sectional area increased by the cross-sectional area of the filler foil conductor 42. The use of the filler strip 42 in FIGS. 5 and 6 not only allows the conductor cross-sectional area to be increased but it also enables the use of dissimilar conductor materials. For example, it allows one to use a copper outer wrap 30 and an aluminum strip inner filler 42. This provides the additional advantage of low material costs for nearly equal losses as a solid copper conductor area, due primarily to skin effect where the current mostly flows at the outer surface of the conductor cross-section. Also the edges of the foil conductor after wrapping are butted together at the center of the turn-to-turn space, where the electrical field is uniform and much lower than at the turn edge. This is a substantial advantage and can be done at a low manufacturing cost.

The present method also has the advantage that the width of the folded insulated foil conductor may be varied without changing the width of the conductor and insulation materials. This is accomplished by during the first folding step, FIG. 3 the width of the central portion 16 of the "U" is increased and the length of the two leg portions 18 and 20 are correspondingly decreased so that when the leg portions of the "U" are folded inwardly to a position substantially parallel to the central portion of the "U", FIG. 4, the free ends 18*a,* 20*a* of the leg portions 18 and 20 are spaced apart a distance corresponding to the increased width of the central portion 16 of the "U". This variation in the method may also be utilized in connection with the addition of the un-insulated filler foil strip 42 in FIGS. 5 and 6. In this aspect of the invention the width of the filler strip 42 will be increased correspondingly with the increase in width of the central portion 36 of the "U".

The present invention provides a method for producing various insulated conductor sizes during the transformer coil winding process by simply slitting and folding standard insulating sheet materials and foil sheet conductor on the fly. By slitting on the fly any foil width can be folded into near any cross-sectional size. The present invention also includes a method for varying the conductor cross-sectional area by folding the foil sheet conductor over additional filler foil strips.

While there has been described a preferred embodiment of the invention, it will be understood that further modifications may be made without departing from the spirit and scope of the invention as set forth in the appended claims.

What is claimed is:

1. A folded insulated foil conductor for distribution transformers comprising:

a length of sheet insulation material bonded to a corresponding length of foil conductor material to provide a length of flat composite foil conductor/insulation, the length of composite conductor/insulation being folded longitudinally into a substantially U-shaped length having horizontal portion between two leg portions with each leg portion having a free end, an un-insulated filler foil conductor strip disposed centrally in said folded insulated foil conductor and the leg portions of the U-shaped length of composite foil conductor/insulation being folded inwardly to a position substantially parallel to the horizontal central portion of the U-shaped length of composite foil conductor/insulation to bring the free ends of the leg portions into opposing relation to provide a folded insulated foil conductor having two conductor thickness surrounded by insulation, said un-insulated filler foil conductor strip increasing the conductor cross-sectional area of the folded insulated foil conductor.

2. A folded insulated foil conductor according to claim 1 wherein said length of foil conductive material and said un-insulated filler foil conductor strip are made of the same conductor materials.

3. A folded insulated foil conductor according to claim 1 wherein said length of foil conductive material and said un-insulated filler foil conductor strip are made of dissimilar conductor materials.

4. A folded insulated foil conductor according to claim 3 wherein one of said conductor materials is copper and the other conductor material is aluminum.

5. A folded insulated foil conductor according to claim 3 wherein said length of foil conductor material is aluminum and said un-insulated filler foil conductor strip is copper.

6. A method of making a folded insulated conductor comprising the steps of bonding a length of sheet insulation material to a corresponding length of a conductor material to provide a length of flat composite conductor/insulation, folding the length of composite conductor/insulation longitudinally into a substantially U-shaped length having a central portion between two leg portions with each leg portion having a free end, inserting an un-insulated filler conductor strip having a width corresponding to the central portion of the U-shaped length of said composite conductors/inslation and folding the leg portions of the U-shaped length of composite conductor/insulation inwardly to a position substantially parallel to the central portion of the "U" to bring the free ends of the leg portions into opposing relation to provide a folded insulated conductor having two conductor thickness surrounded by insulation, said un-insulated filler conductor strip increasing the conductor cross-sectional area of the folded insulated conductor.

7. The method according to claim 1 wherein said length of conductor material and said un-insulated filler conductor strip are made of the same conductor materials.

8. The method according to claim 1 wherein said length of conductor material and said un-insulated filler conductor strip are made of dissimilar conductor materials.

9. The method according to claim 8 wherein one of said conductor materials is copper and the other conductor material is aluminum.

10. The method according to claim 1 wherein said length of conductor material is aluminum and said un-insulated filler conductor strip is copper.

11. A method according to claim 1 wherein said length of a conductor material is a length of a foil conductor material.

12. A method according to claim 1 wherein said un-insulated filler conductor strip is an uninsulated filler foil conductor trip.

13. The method of making a smooth, rounded edge and tightly insulated turn conductor for distribution transformers comprising the steps of:

feeding a length of sheet insulation material to an assembly station, feeding a length of foil conductor material to the assembly station, at the assembly station, bonding the length of sheet insulation material to a corresponding length of the foil conductor material to provide a length of flat composite foil conductor/insulation, folding the length of composite foil conductor/insulation longitudinally into a substantially U-shaped length having a central portion between two leg portions with each leg portion having a free end, inserting at least one un-insulated filler foil conductor strip into the U-shaped length, and folding the leg portions of the U-shaped length of composite foil conductor/insulation inwardly to a position substantially parallel to the central portion of the U-shaped length of composit foil conductor/insulation to bring the free ends of the leg portions into a substantially abutting relation to provide a folded insulated foil conductor having a two conductor thickness surrounded by insulation and having smooth rounded edges, said un-insulated filler foil conductor strip increasing the conductor cross-sectional area of the folded insulated foil conductor.

14. The method according to claim 13 wherein said length of foil conductor material and said un-insulated filler foil conductor strip are made of the same conductor materials.

15. The method according to claim 13 wherein said length of foil conductor material and said un-insulated filler foil conductor strip are made of dissimilar conductor materials.

16. The method according to claim 15 wherein one of said conductor materials is copper and the other conductor material is aluminum.

17. The method according to claim 15 wherein said length of foil conductor material is aluminum and said un-insulated filler conductor strip is copper.

18. The method of making a folded insulated foil conductor comprising the steps of:

slitting a foil conductor material into a predetermined width, slitting a sheet insulation material into a corresponding width, feeding a length of the slit sheet insulation material to an assembly station, feeding a length of the slit foil conductor material to the assembly station, at the assembly station, bonding the length of sheet insulation material to a corresponding length of the foil conductor material to provide a length of flat composite foil conductor/insulation, folding the length of composite foil conductor/insulation longitudinally into a substantially U-shaped length of composite foil conductor/insulation shaped length having a central portion between two leg portions with each leg portion having a free end, and folding the leg portions of the U-shaped length of composite foil conductor/insulation inwardly to a position substantially parallel to the central portion of the U-shaped length of composite foil conductor/insulation to bring the free ends of the leg portions into opposing relation to provide a folded insulated foil conductor having a two conductor thickness surrounded by insulation and wherein the width of the folded insulated foil conductor can be varied without changing the width of the conductor and insulation materials whereby during the first folding step the width of the central portion of the "U" is increased and the length of the two leg portions are correspondingly decreased so that when the leg portions of the "U" are folded inwardly to a position substantially parallel to the central portion of the "U" the free ends of the leg portions are spaced apart a distance corresponding to the increased width of the central portion of the "U".

19. The method according to claim 18 wherein both the foil conductor material and the sheet insulation material are moving during the step of slitting each of them.

20. The method according to claim 19 wherein both the sheet insulation material and the foil conductor material are moving during the step of bonding.

21. The method according to claim 18 wherein the sheet insulation material and the foil conductor material are moving during all of the steps of the method of making the folded insulated foil conductor.

* * * * *

UNITED STATES PATENT AND TRADEMARK OFFICE

CERTIFICATE OF CORRECTION

PATENT NO. : 6,080,935

DATED : June 27, 2000

INVENTOR(S) : Lanoue et al.

It is certified that error appears in the above-identified patent and that said Letters Patent is hereby corrected as shown below:

Col 1, line 13, "These" should read --Such--

Col. 5, line 61 (claim 13), "composit" should read --composite--

Signed and Sealed this

Third Day of April, 2001

*Attest:*

Nicholas P. Godici

NICHOLAS P. GODICI

*Attesting Officer*

*Acting Director of the United States Patent and Trademark Office*